US008764577B2

(12) United States Patent
Kivini

(10) Patent No.: US 8,764,577 B2
(45) Date of Patent: Jul. 1, 2014

(54) DRIVING BOARD FOR GOLF TRAINING

(75) Inventor: Tapani Kivini, Tampere (FI)

(73) Assignee: Kivini Consutling Oy, Tampere (FI)

( * ) Notice: Subject to any disclaimer, the term of this patent is extended or adjusted under 35 U.S.C. 154(b) by 0 days.

(21) Appl. No.: 13/992,032

(22) PCT Filed: Dec. 7, 2011

(86) PCT No.: PCT/FI2011/000051

§ 371 (c)(1),
(2), (4) Date: Jun. 6, 2013

(87) PCT Pub. No.: WO2012/076744

PCT Pub. Date: Jun. 14, 2012

(65) Prior Publication Data

US 2013/0267342 A1 Oct. 10, 2013

(30) Foreign Application Priority Data

Dec. 7, 2010 (FI) ..... 20100411

(51) Int. Cl.
*A63B 69/36* (2006.01)

(52) U.S. Cl.
USPC ..... 473/279; 473/278

(58) Field of Classification Search
USPC ..... 473/160, 161, 169, 278, 279
See application file for complete search history.

(56) References Cited

U.S. PATENT DOCUMENTS

| | | | | |
|---|---|---|---|---|
| 3,936,055 | A * | 2/1976 | Scott | 473/160 |
| 4,779,796 | A * | 10/1988 | Lai | 473/279 |
| 5,518,245 | A * | 5/1996 | Nelson | 473/279 |
| 6,514,152 | B1 | 2/2003 | Huang et al. | |
| 6,623,370 | B1 * | 9/2003 | Willer | 473/169 |
| 7,758,444 | B2 | 7/2010 | Crossley | |
| 2004/0142759 | A1 * | 7/2004 | Gianfagna et al. | 473/278 |

OTHER PUBLICATIONS

International Search Report for PCT/FI2011/000051 dated Mar. 20, 2012.

* cited by examiner

*Primary Examiner* — Nini Legesse
(74) *Attorney, Agent, or Firm* — Douglas E. Jackson; Stites & Harbison PLLC

(57) ABSTRACT

Driving board for training golf comprising a basal plane (2), the first inclined plane (3, 4) which is supported by the supporting rolls being located on top of the basal plane and is adjusted to revolve in relation to the basal plane and comprises a second inclined plane (5,6) which is supported by the supporting rolls being located on top of the first inclined plane and is adjusted to revolve both in relation to the basal plane and in relation to the first inclined plane. Regarding the three mentioned plane (2); (3, 4) and (5, 6) at least one plane has nests (8) into which the rolls (7) belonging to the adjacent plane get settled while locking their reciprocal rotation.

6 Claims, 2 Drawing Sheets

DRIVING BOARD FOR GOLF TRAINING

THE OBJECT OF THE INVENTION

The object of the invention is a driving board for golf training.

BACKGROUND OF THE INVENTION

The majority of the driving training related to golf is done at training places in which the golf ball is in practice struck at a planar board.

However, the actual game is played at the fields built to the nature and ground in which the player performs his various strikes mainly at a base which is diagonal in a certain direction. The opening strike happens at a direct and even base.

Various stands and built bases are known for the striking training which stands and bases function as striking bases and with which stands and bases one can simulate the alternations of the declination of the field. The striking base can be set to a wanted angle for the training and the hitter takes his place on top of the striking base for the training. Thus with the help of a striking base located on top of an even ground or a floor one can get a feeling of a varying ground of a golf field.

Various striking bases are shown in the publications U.S. Pat. No. 5,518,245-A, U.S. Pat. No. 6,514,152-B1 and WO-2006/037168-A1.

SHORT SUMMARY OF THE INVENTION

A driving board according to the invention is shown in the claim 1.

The advantage of one shown solution is a very simple and reliable mechanical solution. The mechanical structure of the striking base allows both the changing of the angle of inclination of the striking base and the usage of an adjusted angle of deflection in various striking positions when one however strikes in the same striking direction.

The striking base according to the solution is easy and simple to use.

The striking base enables the utilization of predetermined angles of inclination when the various parts of the striking base become locked to each other only at certain positions.

DESCRIPTION OF THE DRAWINGS

In the following the solution is described more detailed by referring at the same time to the accompanying drawings in which.

DETAILED DESCRIPTION OF THE INVENTION

Figure 1:
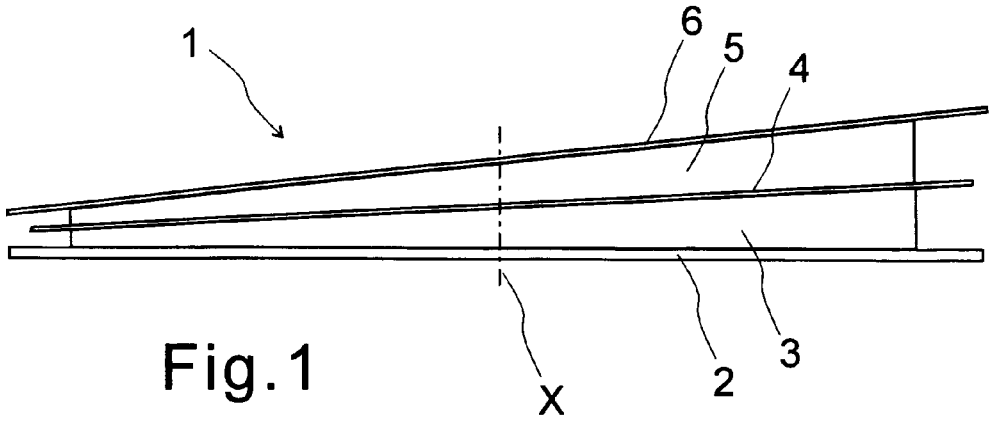
FIG. 1 shows a striking base as a side view.

In the FIG. 1 a striking base 1 according to one embodiment is shown assembled and as a side view. The striking base 1 comprises the first inclined, plane which forms a wedge-shaped upper part which comprises an upper plane 6 and an upper wedge part 5. The striking base 1 comprises additionally a second inclined plane which forms a wedge-shaped lower part which comprises a middle plane 4 and a lower wedge part 3. The striking base 1 comprises additionally a basal plane 2.

The wedge parts are formed of vertical, direct walls set to have a form of a circle. The height of the walls of the wedge part is chosen in such a way that the plane attached on top of the wedge part gets settled into a predetermined diagonal position also then when the wedge part is located for example on top of a horizontal surface. Alternatively the wedge part is formed of a support which has a shape of a ring or a square, a polygon or has some kind of other advantageous form. The wedge part may also be formed of one or several separate parts which support the plane into a inclined position.

The upper plane 6 becomes attached to the upper wedge part 5 and the middle plane 4 becomes attached to the lower wedge part 3. A suitable coating, for example a striking mat, can be attached to the upper surface of the upper plane 6. The wedge-shaped lower part is located to be rotating on top of the basal plane 2 and the wedge-shaped upper part is located to be rotating on top of the middle plane 4. The wedge-shaped lower part and the wedge-shaped upper part revolve around a common, essentially vertical rotation axis X. The rotation axis X is located essentially vertically in relation to the basal plane 2.

Figure 2:
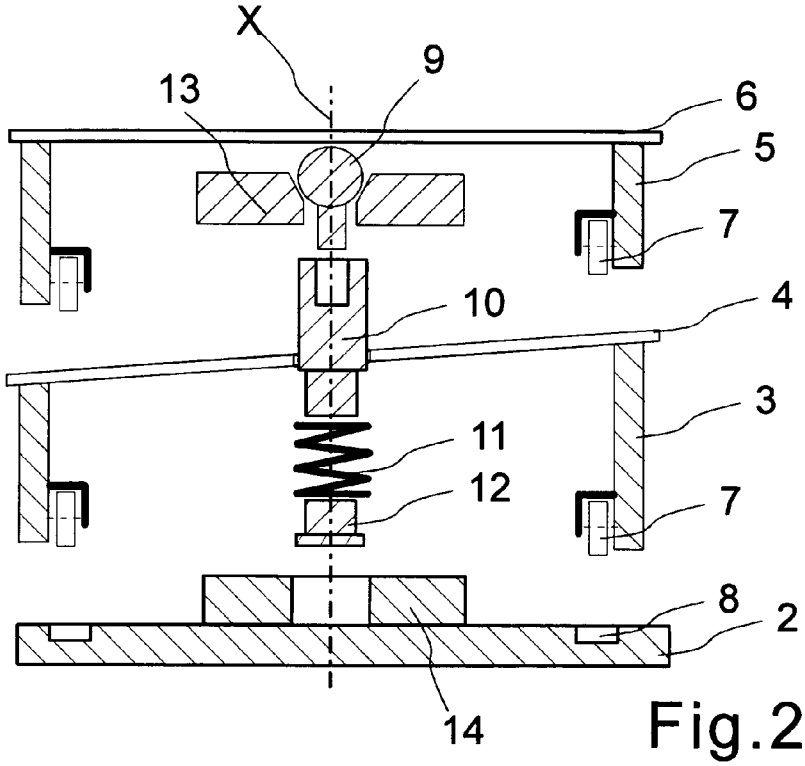
FIG. 2 shows principles and parts of the structure of the striking base according to one example as a cross section, as a side view and as a simplified basic drawing.

In the FIG. 2 a mechanism of the striking base 1 according to one example is shown more detailed with the help of which mechanism the rotation of the wedge-shaped upper part and the wedge-shaped lower part in relation to each other and additionally in relation to the basal plane 2 has been made possible. The rotation axis X runs through the structure of the middle axis 10.

The mechanism comprises a middle axis 10 which penetrates into a basal plane 2. The middle plane 4 and the upper plane 6 penetrate for their part into the middle axis 10. In the usage position the middle axis 10 is essentially vertical and essentially upright in relation to the horizontal direction defined by the basal plane 2. The middle axis 10 is connected to the basal plane 2 in such a way that the movement of the middle axis 10 in a crosswise direction is prevented, that is the movement in relation to the rotation axis X in a upright direction is prevented. The middle axis 10 is connected to the upper plane 6 in such a way that the movement of the upper plane 6 in a crosswise direction in relation to the middle axis 10 is prevented but at least the movement up in a direction of the rotation axis X is allowed. The middle axis 10 is additionally connected to the upper plane 6 in such a way that the variation of the declination of the upper plane 6 and its direction in relation to the middle axis 10 is allowed.

The upper end of the middle axis 10 forms a ball joint 9 according to the example of the FIG. 2 on which ball joint the upper plane 6 rests through the upper support 13. The upper support 13 becomes attached to the lower surface of the upper plane 6 and keeps the ball joint 9 attached to the upper plane 6 also then when the upper plane 6 is detached from the striking base 1. The ball joint 9 rotates with the upper plane 6 or stays at its place in relation to the middle axis 10. The ball joint 9 is connected to the middle part of the middle axis 10 through a centralizing peg or an attachment. The lower end of the middle axis 10 comprises a structure which rests on the basal plane 6 through a spring 11 in such a way that the spring 11 aims to lighten the upper plane 6 through the middle axis 10.

The lower end of the middle axis 10 comprises for example a lower sleeve 12 which rests on the basal plane 2 through a lower support 14 and the concerned lower support 14 centralizes the middle axis 10. The lower support 14 becomes attached to the upper surface of the basal plane 2. The middle axis 10 comprises additionally an upper sleeve which is formed to the middle axis 10. The spring 11 centralizes the upper sleeve and the lower sleeve and rests on them at the same time. When the striking base 1 is assembled, the spring 11 is compressed and directs a force to the upper plane 6 which force partly compensates the adversative force caused by the weight of the upper plane 6, wedge-shaped upper part and the coating of the upper surface of the plane 6.

In one example the spring 11 can also be missing from the structure of the middle axis 10 in which case the middle axis 10 rests directly on the basal plane 2. The ball joint 9 can also be a fixed part of the middle axis 10. The middle axis 10 can also in one example rotate around the rotation axis X in relation to the basal plane 2. When the upper plane is loaded, the upper plane rests on the basal plane 2 through the middle axis 10 so that there would be less elasticity at the upper plane 6.

The middle axis 10 runs through the middle plane 4, for example through a hole. In the shown example a hole has been formed to the middle plane 4 to which hole the middle axis 10 gets settled and at the same time keeps the middle plane 4 at its place in such a way that the middle plane 4 becomes centralized and the movement of the middle plane 4 in a crosswise direction in relation to the middle axis 10 has been prevented, but at least the movement up in the direction of the rotation axis X has been allowed.

In one example the structure of the middle plane 4 and the basal plane 2 is circular or annular when the rotation axis X becomes located at their centre. In that case there is a structure attached to the middle plane 4 and the basal plane 2 which structure supports the middle axis 10 or rests on the middle axis 10. Alternatively the middle axis 10 comprises an analogous structure.

Figure 5:
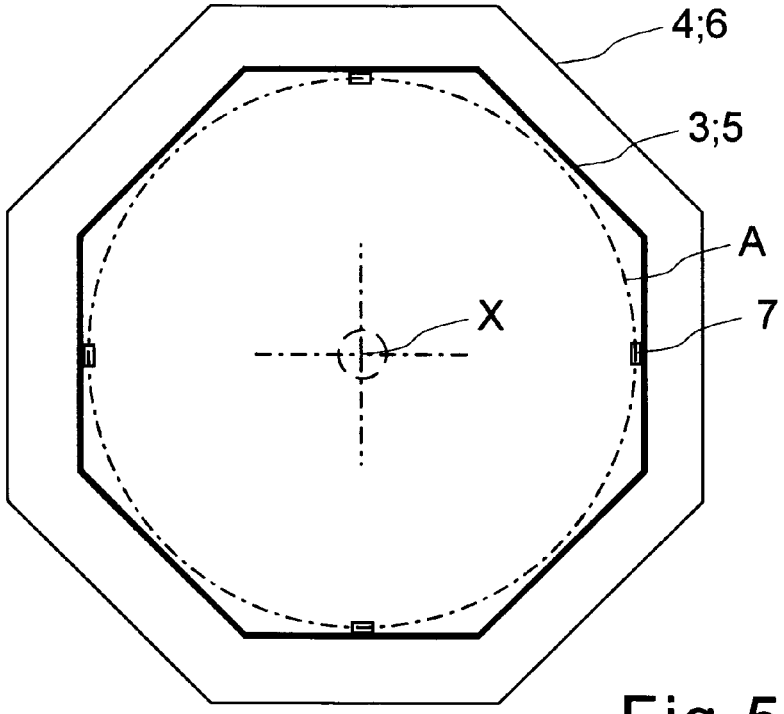
FIG. 5 shows the wedge-shaped upper part or the lower part of the striking base seen from below.

In the FIG. 5 an upper plane 6 and an upper wedge part 5 attached to it are shown. Supporting rolls 7 are attached to the upper wedge part 5 which supporting rolls support the upper wedge part 5 and the upper plane 6. The height and the direction of the supporting rolls 7 are adjusted in such a way that they roll along the upper surface of the middle plane 4 when the upper plane 6 revolves around the rotation axis X. The supporting rolls 7 are located at the annulus A of the circle into the inside of which the rotation axis X becomes centrally located.

Figure 6:
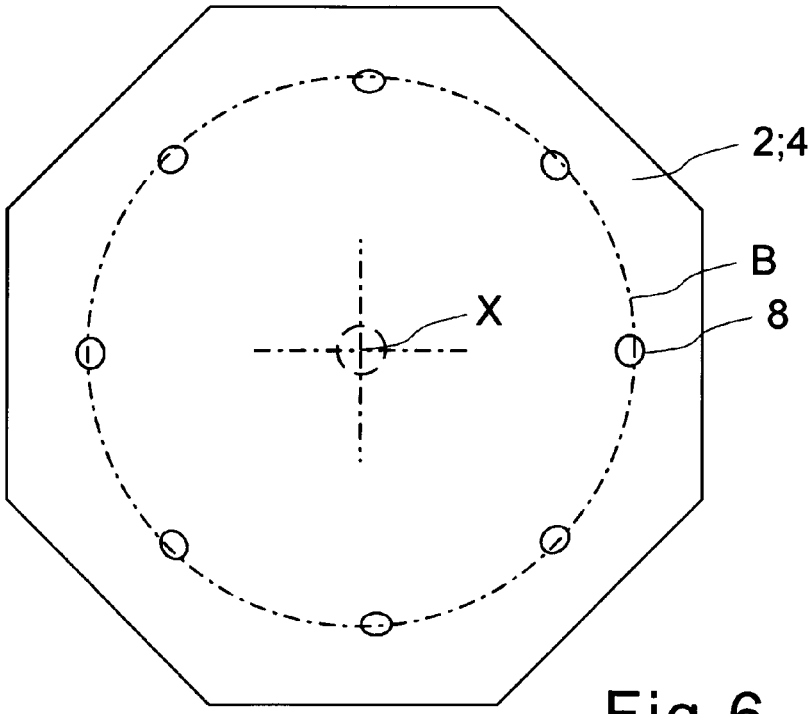
FIG. 6 shows the wedge-shaped lower part or the basal plane of the striking base seen from above.

In the FIG. 6 a middle plane 4 is shown onto the upper surface of which nests 8 are located. Each nest 8 can form for example a cavity, a gap or a hole into which one supporting roll 7 drops and gets settled at its place. The nests 8 are located at the annulus B of the circle into inside of which the rotation axis X becomes centrally located. The supporting rolls 7 are adjusted at the annulus A in such a way that the supporting rolls 7 run along the annulus B on top of the middle plane 4 and move from one nest 8 to another for locking when the upper plane 6 revolves around the middle axis 10. The annuli A and B are approximately coaxial and have the same size.

In the analogous way the FIG. 5 shows alternatively a middle plane 4 and the lower wedge part 3 attached to it which wedge part has supporting rolls 7. The FIG. 6 for its part shows alternatively a basal plane 2 onto the upper surface of which nests 8 are located. The supporting rolls 7 are adjusted at the annulus A in such a way that they run along the annulus B on top of the basal plane 2 when the middle plane 4 revolves around the middle axis 10.

Figure 3:
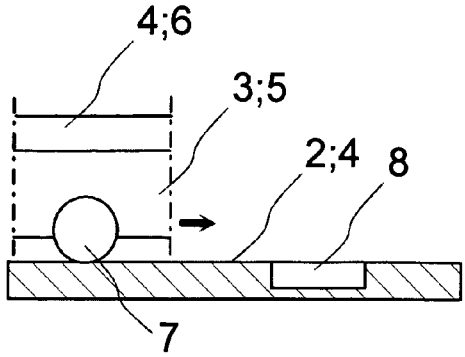
FIG. 3 shows rolling of the supporting roll of the striking base along a plane.
Figure 4:
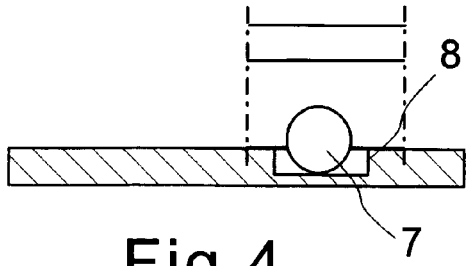
FIG. 4 shows the settling of the supporting roll of the striking base into a nest.

According to the FIG. 3 the supporting roll 7 raises the upper wedge part 5 in such a way that it revolves and rolls along the middle plane 4 with the help of a supporting roll 7. Alternatively the roll 7 raises the lower wedge part 3 in such a way that it revolves and rolls along the basal plane 2. According to the FIG. 4 the supporting roll 7 gets settled at the nest 8 at the desired location and the most advantageous way is the way that all the supporting rolls 7 are located at the nests 8 at the same time. The supporting roll 7 stays at the nest 8 and at the same time aims to resist for example the rotation of the upper plane 6 and the middle plane 4 in relation to each other. When the supporting roll 7 is located at the nest 8, the most advantageous way is that the upper wedge part 5 rests on the middle plane 4 and the lower wedge part 3 rests on the basal plane 2. In order to turn the upper plane 6 or the middle plane 4 one must use enough force so that the supporting rolls 7 would rise from the nests 8. The sliding of certain planes can be arranged also without rolls and nests when the counter parts are sliding together.

There are nests 8 at the annulus B at predetermined distances in such a way that the upper plane 6 and the middle plane 4 can be turned in relation to each other for a predetermined angle amount after which the supporting rolls 7 get settled again into the nests 8. The spacing of the supporting rolls 7 at the annulus A and the spacing of the nests 8 at the annulus B are adjusted to match each other. In the examples of the FIGS. 5 and 6 there are nests 8 8 pieces so that the change of the angle amount is at least 45°.

The striking base 1 is assembled in such a way that a immovable basal plane 2 will be the lowest part on top of which the lower wedge part 3 with its middle planes 4 for its part comes on top of which wedge part the upper wedge part 5 with its upper planes 2 for its part comes. The middle axis 10 combines various components and enables the revolving of them in relation to each other around the rotation axis X. In order to set the desired deviation of the striking base 1, the upper plane 6 is rotated (rotation axis X) in relation to the middle plane 4. The middle plane 4 is in a diagonal position in relation to the basal plane 2.

The angle between the middle plane 4 and the basal plane 2 stays constant and it is determined on account of the structure of the lower wedge part 3.

The angle between the upper plane 6 and the middle plane 4 and also the angle between the upper plane 6 and the basal plane 2 for its part depends on the fact to which position the upper plane 6 has been twisted (rotation axis X) in relation to 4 to the middle plane. The most advantageous way is the way that the structure of the upper wedge part 5 is measured in such a way that the upper plane 4 can be rotated to a position in which it is essentially parallel with the basal plane 2, for example to be horizontal. The angle between the basal plane 2 and the upper plane 6 is for its part at its widest then when the upper plane 6 and the middle plane 4 recede in the same direction according to the FIG. 1 and their lowest points are rotated to the same location.

The desired inclination of the striking base 1 can be chosen by rotating the upper plane 6 in relation to the middle plane 4. In case it is necessary to direct the inclination in a certain direction, for example for the striking training, then the alignment occurs by turning the middle plane 4 at the same time with the upper plane 6 in relation to the basal plane 2. The turning of the upper plane 6 together with the middle plane 4 is possible especially then when the supporting rolls 7 are located at the nests 8.

The structure is made for example of aluminum, wood or wood based materials. The upper plane, middle plane and basal plane are for example plates forming a flat upper surface, they are laminar or planar pieces. Needed nests are made into the concerned pieces for the rolls or a hole is made for the middle axis. Various parts are attached to each other by using an appropriate attachment element and a method. The form of the planes can have a form of a square, it can be a polygon, round or have another appropriate form. The most advantageous form is a polygon in which case the number of the angles is equivalent to the number of the predetermined rotary positions of the striking plane.

The supporting rolls can also move along such a groove which is adjusted at the annulus B and the nests are located by the mentioned groove. The nests and/or the groove are most advantageously tooled into pieces for example by drilling in which case one avoids attachment of separate bars or elements to the piece. Alternatively the supporting rolls move along a bar or a track which is a separate part and to which the above mentioned nests are formed.

The invention is not limited only to the above mentioned example but it can vary within the limits of the accompanying claims.

The invention claimed is:

1. Driving board for golf training comprising:

a basal plane;

a first inclined plane which is located on top of the basal plane and which is configured to revolve in relation to the basal plane; and a second inclined plane which is located on top of the first inclined plane and which is configured to revolve both in relation to the basal plane and in relation to the first inclined plane;

wherein at least one of the basal plane, the first inclined and the second inclined plane has nests into which supporting rolls belonging to an adjacent one of the planes get settled while locking the associated reciprocal rotation.

2. Driving board according to the claim 1, wherein the supporting rolls have a first annulus and the nests have a second annulus, and the sizes of the annuli are essentially equivalent to each other such that the supporting rolls run through the nests during the rotation.

3. Driving board according to the claim 1, further comprising a middle axis, in relation to which the rotation of the first and the second inclined planes occurs and additionally the middle axis rests on the basal plane, runs through the first inclined plane and becomes connected to the second inclined plane; and in which the middle axis comprises a ball joint which is connected to the second inclined plane and allows variations of the direction of the inclination of the second inclined plane.

4. Driving board according to the claim 3, wherein an upper end of the middle axis forms the ball joint to which the second inclined plane becomes connected and a lower end of the middle axis forms a structure which rests on the basal plane through a spring so that the spring aims to compensate force generated by the weight of the second inclined plane through the middle axis.

5. Driving board according to the claim 3, wherein the lower end of the middle axis additionally comprises a lower sleeve on which a spring rests and which for its part-rests on the basal plane through a lower support, and the lower support is attached to the basal plane and is adjusted to centralize the middle axis.

6. Driving board according to the claim 1, wherein two of the basal plane, the first inclined plane and the second inclined plane are adjusted to revolve in relation to each other without rolls and nests when the uppermost one of the two planes is sliding on top of the lowermost one of the two planes.

* * * * *